US011511918B2

(12) United States Patent
Sterling et al.

(10) Patent No.: US 11,511,918 B2
(45) **Date of Patent: *Nov. 29, 2022**

(54) CHILD-RESISTANT CONTAINER HAVING CAP RETAINER FEATURES

(71) Applicant: HENKEL AG & CO. KGAA, Duesseldorf (DE)

(72) Inventors: Daniel Peter Sterling, Fairfield, CT (US); Keith Colacioppo, Harrison, NY (US)

(73) Assignee: HENKEL AG & CO. KGAA, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/073,632

(22) Filed: Oct. 19, 2020

(65) Prior Publication Data

US 2021/0047088 A1 Feb. 18, 2021

Related U.S. Application Data

(62) Division of application No. 16/230,215, filed on Dec. 21, 2018, now Pat. No. 10,850,898.

(51) Int. Cl.

| | |
|---|---|
| ***B65D 50/08*** | (2006.01) |
| ***B65D 50/04*** | (2006.01) |
| ***B65D 41/04*** | (2006.01) |

(52) U.S. Cl.

CPC ..... *B65D 50/043* (2013.01); *B65D 41/0471* (2013.01); *B65D 50/046* (2013.01)

(58) Field of Classification Search

CPC .. B65D 50/046; B65D 50/066; B65D 50/045; B65D 43/0231; B65D 43/0283; B65D 41/0471; B65D 41/0485

USPC ..... 215/209

See application file for complete search history.

(56) References Cited

U.S. PATENT DOCUMENTS 4,630,743 A * 12/1986 Wright ..... B65D 41/3404 215/253
2009/0045224 A1* 2/2009 Faaborg ..... B65D 41/0471 215/44

FOREIGN PATENT DOCUMENTS

GB 2218694 A * 11/1989 ..... B65D 50/046
WO WO-2017200922 A1 * 11/2017 ..... B65D 50/046

* cited by examiner

*Primary Examiner* — Allan D Stevens
(74) *Attorney, Agent, or Firm* — Lorenz & Kopf, LLP

(57) ABSTRACT

A container body has a neck defining an opening with an axis. The neck includes a projection that projects radially away from the axis. A cap includes a wall that defines at least part of an exterior of the cap. The wall includes an aperture extending therethrough. The cap is removably attached to the neck and supported for movement on the neck between a first position and a second position. The wall is resiliently flexible for radial movement between a retained position and an unretained position with respect to the neck. In the retained position the projection retains the cap in the first position. The wall, in the unretained position, allows movement of the cap from the first position toward the second position.

19 Claims, 8 Drawing Sheets

CHILD-RESISTANT CONTAINER HAVING CAP RETAINER FEATURES

CROSS-REFERENCE TO RELATED APPLICATIONS

The following is a divisional application of co-pending U.S. patent application Ser. No. 16/230,215, filed Dec. 21, 2018, the entire disclosure of which is incorporated by reference.

TECHNICAL FIELD

The following relates to a container and relates, more particularly, to a child-resistant container having cap retainer features.

BACKGROUND

A child-resistant container is designed to reduce the ease with which children are able to access the contents stored within the container. A container body having a neck may be rendered child-resistant through the usage of a specialized cap. Certain actions may be needed to detach the cap from the container body, and those actions may be typically difficult for a child to perform.

While often relatively non-complex in a structural sense, child-resistant cap assemblies can be deceptively difficult to design. An inexorable tradeoff is encountered in designing a child-resistant cap assembly that the vast majority of adults find intuitive and relatively non-cumbersome to use, while most children find prohibitively difficult to open. Relatively few, if any conventional child-resistant cap assemblies strike an ideal balance between these competing factors. There thus exists an ongoing demand for child-resistant containers providing enhanced child deterrence characteristics, while further maintaining or improving adult ease-of-use. Concurrently, it would be desirable for such child-resistant cap assemblies to be amenable to cost effective manufacture.

BRIEF SUMMARY

Embodiments of a child-resistant container are provided. In various embodiments, the child-resistant container includes a container body having a neck that defines an opening to an inner cavity within the container body. The opening defines an axis extending therethrough. The neck includes a projection that projects radially away from the axis. The container further includes a cap with a wall that defines at least part of an exterior of the cap. The wall includes an aperture extending therethrough. The cap is removably attached to the neck and supported for movement on the neck between a first position and a second position. The wall is resiliently flexible for radial movement between a retained position and an unretained position with respect to the neck. The wall, in the retained position, is disposed proximate the neck with the projection received in the aperture to retain the cap in the first position. The aperture visibly exposes the projection from the exterior of the cap to visually confirm the cap is in the retained position. The wall, in the unretained position, is spaced apart radially away from the projection with the projection outside the aperture to allow movement of the cap from the first position toward the second position.

Embodiments of a child-resistant cap for a container body is further provided. The container body includes an opening to an inner cavity, and the container body includes a projection. In some embodiments, the child-resistant cap includes a cover member configured to cover over the opening. The cap also includes an inner skirt that depends from the cover member and that is centered about an axis. The inner skirt is configured to threadably engage the container body and move between a first threaded position and a second threaded position relative to the container body. The cap also includes an outer skirt that depends from the cover member and that extends about the inner skirt and the axis. The outer skirt includes a wall that partly defines an exterior of the cap. The wall includes an aperture extending therethrough. The wall is resiliently flexible for radial movement between a retained position and an unretained position with respect to the axis. The wall, in the retained position, is configured to be disposed with the projection received in the aperture to retain the cap in the first threaded position. The wall, in the unretained position, is configured to be disposed radially from the projection with the projection disposed outside the aperture to allow movement of the cap from the first threaded position to the second threaded position.

Methods for manufacturing a child-resistant container are still further provided. In some embodiments, the method includes providing a container body having a neck that defines an opening to an inner cavity within the container body. The opening defines an axis extending therethrough. The neck includes a projection that projects radially away from the axis. The method further includes attaching a cap in a first position on the neck of the container with the projection received within an aperture of a wall of the cap. The wall partly defines an exterior of the container. The cap is supported for movement on the neck from the first position toward a second position. The wall is resiliently flexible for radial movement between a retained position and an unretained position with respect to the neck. The wall, in the retained position, is disposed proximate the neck with the projection received in the aperture to retain the cap in the first position. The aperture visibly exposes the projection from the exterior of the container to visually confirm the cap is in the retained position. The wall, in the unretained position, is spaced apart radially away from the projection with the projection outside the aperture to allow movement of the cap from the first position toward the second position.

The foregoing statements are provided by way of non-limiting example only. Various additional examples, aspects, and other features of embodiments of the present disclosure are encompassed by the present disclosure and described in more detail below.

BRIEF DESCRIPTION OF THE DRAWINGS

At least one example of the present disclosure will hereinafter be described in conjunction with the following figures, wherein like numerals denote like elements, and.

Figure 1:
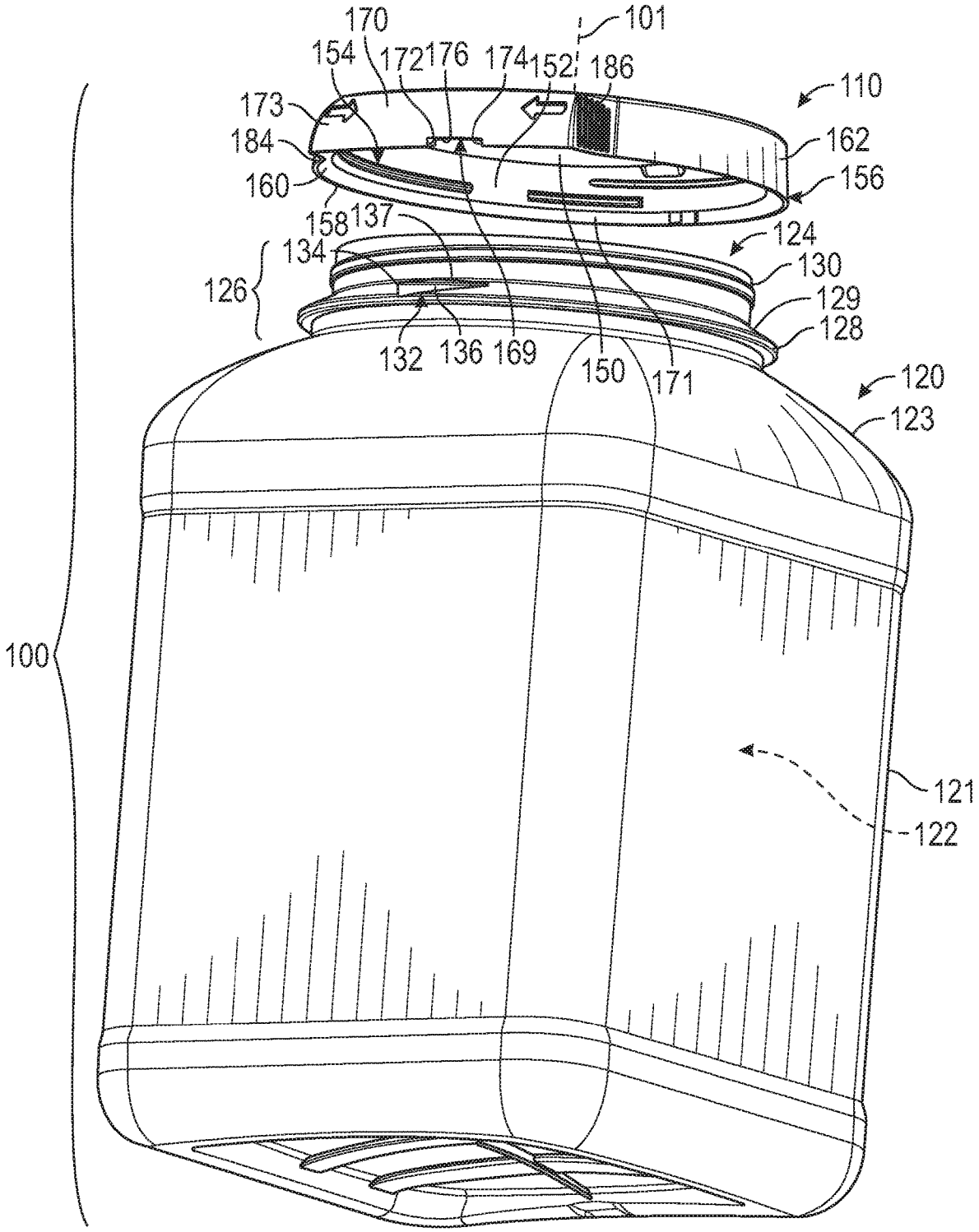
FIG. 1 is an exploded isometric view of a child-resistant container from a front side vantage point according to example embodiments of the present disclosure.

For simplicity and clarity of illustration, descriptions and details of well-known features and techniques may be omitted to avoid unnecessarily obscuring the exemplary and non-limiting embodiments of the present disclosure described in the subsequent Detailed Description. It should further be understood that features or elements appearing in the accompanying figures are not necessarily drawn to scale unless otherwise stated.

DETAILED DESCRIPTION

The following Detailed Description is merely exemplary in nature and is not intended to limit the present disclosure or the application and uses of the same. The term "exemplary," as appearing throughout this document, is synonymous with the term "example" and is utilized repeatedly below to emphasize that the following description provides only multiple non-limiting examples of the present disclosure and should not be construed to restrict the scope of the present disclosure, as set-out in the Claims, in any respect.

Child-resistant containers (i.e., child-deterring containers) including child-resistant caps and corresponding container bodies are provided, as are methods for manufacturing such articles. Generally, the child-resistant containers described herein and their components restrict access to the package contents in a manner providing effective child deterrence, while further ensuring adult ease-of-use. This is principally accomplished through the provision of a container body with a neck and a cap with corresponding child-deterring features.

For example, the container may include a child-deterring feature wherein the neck includes an opening and a projection that projects radially with respect to an axis of the opening. Also, the cap may include an aperture configured to receive the projection to retain and secure the cap on the neck. The wall on the cap with the aperture may be moveable in the radial direction such that the cap moves away from the projection and the projection of the neck withdraws from the aperture of the cap, thereby allowing the cap to be removed from the neck (e.g., by rotating the cap relative to the neck). In some embodiments, the wall may resiliently recover and move back in the radial direction for re-attaching the cap to the neck and for re-inserting the projection into the aperture to retain and secure the cap (i.e., to reposition the aperture around/over the projection).

More specifically, in some embodiments, the cap may be threadably attached to the neck such that the cap may be rotated in a first direction relative to the neck and threadably advanced along the axis for attachment to the neck (i.e., a "twist-on" direction) and rotated in an opposite, second direction relative to the neck and threadably advanced in an opposite direction along the axis for removal from the neck (i.e., a "twist-off" direction). In some embodiments, the projection on the neck may be received in the aperture of the cap in a predetermined threaded position on the neck (e.g., a fully threaded position). The projection may interfere with one or more surfaces that define the aperture as the user attempts to move the cap relative to the neck in the twist-off direction. As such, the cap may be secured on the neck (i.e., the cap may remain substantially fixed relative to the neck) in this fully threaded and retained position. Accordingly, these features may frustrate and deter a user, such as a small child, etc., from gaining access to the contents of the container. The wall may be resiliently flexible and may be selectively flexed outward in the radial direction and/or upward in a diagonal or arcuate direction for withdrawing the projection from the aperture and disengaging or moving the projection out of interference (i.e., a fully threaded but unretained position). For example, the cap may include pads that may be squeezed in unison (i.e., toward one another) to resiliently flex the wall radially outward, thereby disengaging the projection of the container body from the aperture of the cap. Accordingly, with the wall flexed outward radially, the user may rotate the cap off in the twist-off direction.

In some embodiments, the aperture may extend through a thickness of the wall of the cap. Thus, the aperture may expose the projection from the exterior of the cap when the projection is received within the aperture. This may provide visual confirmation to the user that the cap is secured and retained on the neck in the fully threaded position.

Furthermore, in some embodiments, the child-resistant container of the present disclosure may include a tamper-evident member. For example, in some embodiments, the cap may include a deformable (e.g., frangible) member that engages the neck and retains the cap on the neck (e.g., when in the fully threaded position). The tamper-evident member may be selectively removed from the neck to allow removal of the cap. In some embodiments, the tamper-evident member may be at least partially removable from the cap for disengaging from the neck. For example, the tamper-evident member may be a tear-away tab that may be selectively torn by hand from the cap, thereby disengaging the neck.

In some embodiments, the tamper-evident member may be included in addition to the child-deterring feature discussed above. Accordingly, the container may include redundant features that secure the cap on the neck of the container.

Thus, various aspects of the container of the present disclosure can render the cap relatively challenging for a vast majority of children to defeat or bypass, while maintaining a desired level of ease-of-use for adults. Additionally, as will be discussed, other features may be included in the child-resistant container for improving child deterrence or enhancing adult ease-of-use. Exemplary embodiments of a child-resistant container will now be described in conjunction with FIGS. 1 and 2.

Figure 2:
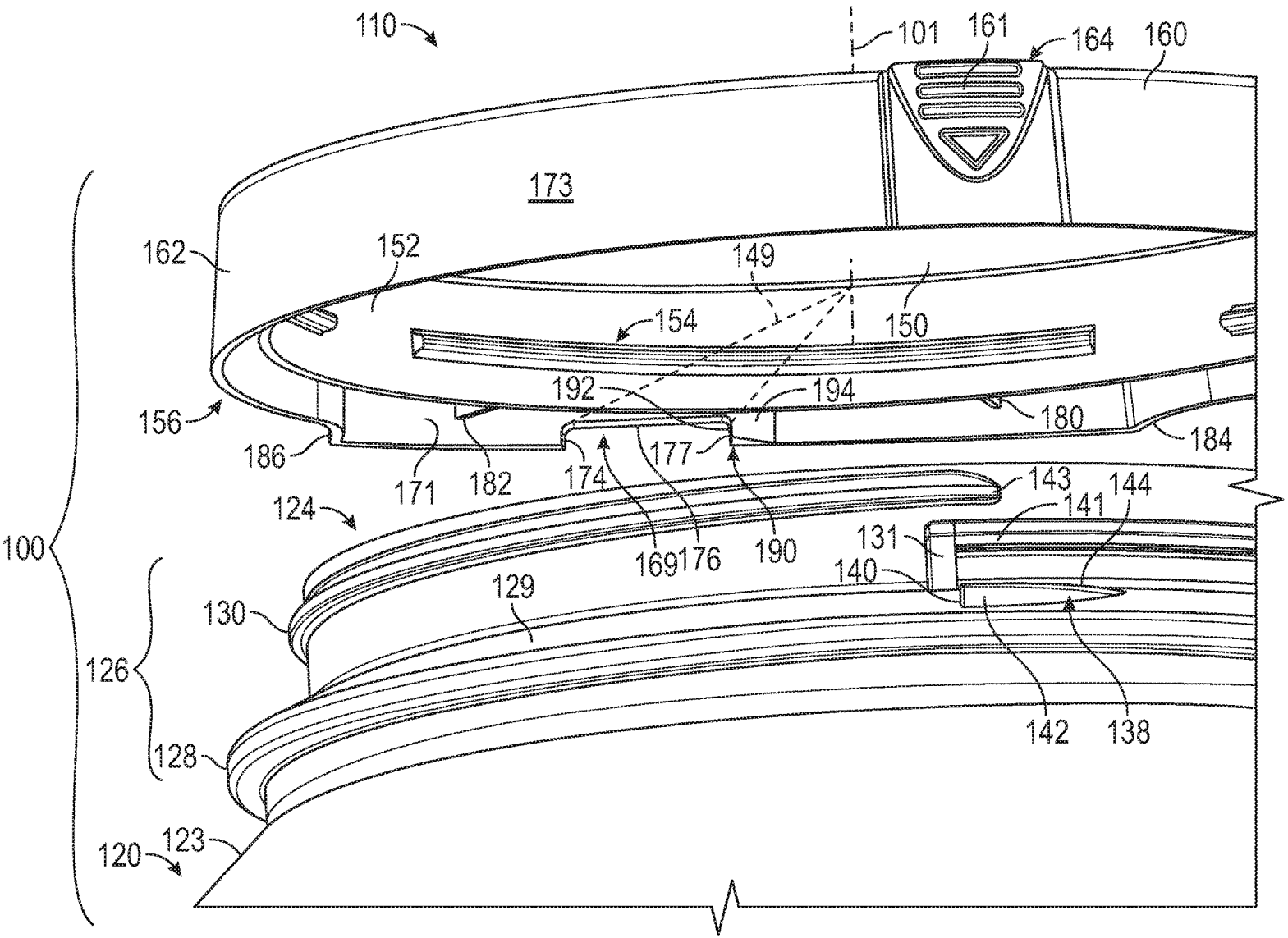
FIG. 2 is an exploded isometric view of a neck and cap of the child-resistant container of FIG. 1 from a rear side vantage point.

FIGS. 1 and 2 illustrate a child-resistant container 100 that generally includes a cap 110 and a container body 120 in accordance with exemplary and non-limiting embodiments of the present disclosure. It will be appreciated that the term "child-resistant" as used herein is used broadly to mean a container that includes one or more features that selectively deters a user, such as a young child, from removing the cap 110 from the body 120 and gaining access to an inner cavity 122 within the container 100. In some embodiments, the child-resistant container 100 may satisfy certain established standards, such as ASTM D3475-15, entitled "Standard Classification of Child Resistant Packages;" however, the child-resistant container 100 may fall outside of such standards without departing from the scope of the present disclosure.

The container body 120 may be a vessel or bottle that is configured for holding single-use detergent capsules in some embodiments. Also, in some embodiments, the container body 120 may be a molded, plastic, and unitary article. It is emphasized, however, that the container body 120 and its contents may vary among different embodiments.

The container body 120 may include a tub portion 121 that defines an inner cavity 122 therein. The tub portion 121 may be cuboid in shape in some embodiments or may be shaped otherwise. The container body 120 may also a neck 126 and a shoulder portion 123 that connects the tub portion 121 and the neck 126. The shoulder portion 123 may taper in width between the tub portion 121 and the neck 126 such that the neck 126 is narrower than the tub portion 121.

The neck 126 may be annular and may define a throat or opening 124 that provides physical access to the inner cavity 122 when the cap 110 is removed from the container body 120. The opening 124 may be substantially circular in some embodiments and may be substantially centered about an axis 101. The tub portion 121, shoulder portion 123, and neck 126 may be integrally formed as a single, unitary (e.g., blow molded) piece in some embodiments. In further embodiments, at least one of these features can be separately fabricated from the same, similar, or dissimilar materials as the others and subsequently joined in some manner. For example, in one implementation, the container neck 126 can be fabricated as a blow molded, injection molded, or additively manufactured piece, while the rest of the container body 120 is separately produced as a non-rigid structure (e.g., a flexible bag or collapsible vessel) to which the neck 126 is subsequently attached. Various other constructions are also possible. While such a structural design will generally be less common than that shown in FIG. 1, this is nonetheless noted to further emphasize that the cap 110 and/or other features of the container 100 are highly adaptable and can be incorporated into a wide range of packaging types.

The neck 126 may include a bead or collar 128 that projects outward radially from the axis 101. The collar 128 may include a frustoconical upper surface 129. The neck 126 may also include a neck thread 130. The neck thread 130 may be a projected rib that extends along the neck 126 helically about the axis 101. As shown in FIG. 2, the neck thread 130 may include a first (lower) end 141 and a second (upper) end 143, and the neck thread 130 may extend continuously between the first and second ends 141, 143. Moreover, the neck 126 may include a thread stop 131 (FIG. 2). The thread stop 131 may be a rectangular projection disposed proximate the first end 141 of the neck thread 130. The thread stop 131 may extend parallel to the axis 101 between upper surface 129 of the collar 128 and the first end 141 of the neck thread 130.

Furthermore, as shown in FIG. 1, the neck 126 may include a first projection 132. The first projection 132 may be a lug, ridge, bump, or other projection that projects outward, radially away from the upper surface 129 of the collar 128 and from the axis 101. The first projection 132 may be wedge-shaped in some embodiments. As such, the first projection 132 may include a substantially planar abutment surface 134. The abutment surface 134 may face in a tangential direction and/or in a circumferential direction with respect to the axis 101 (in a direction that opposes twist-off of the cap 110). The first projection 132 may further include a tapered surface 136. The tapered surface 136 may face outward radially with respect to the axis 101. The tapered surface 136 may extend away from the abutment surface 134 in a generally circumferential direction, and the radius of the tapered surface 136 may gradually reduce as the tapered surface 136 transitions toward the neighboring area of the neck 126. In some embodiments, the tapered surface 136 may have a substantially smaller radius than that of the neck 126, and the tapered surface 136 may be eccentric relative to the axis 101. The first projection 132 may additionally include a top surface 137 that is planar and that is disposed substantially normal to the axis 101.

As shown in FIG. 2, the neck 126 may further include a second projection 138. The second projection 138 may be substantially similar to the first projection 132. For example, the second projection 138 may include a respective abutment surface 140, tapered surface 142, and top surface 144. The abutment surface 140 may be oriented to face in the same circumferential/tangential direction as the abutment surface 134 of the first projection 132 (in the direction opposing twist-off of the cap 110). The second projection 138 and the first projection 132 may be disposed approximately at the same axial position with respect to the axis 101. The second projection 138 may be spaced apart circumferentially from the first projection 132. For example, in some embodiments, the first and second projections 132 138 may be disposed on opposite sides of the axis 101. The first projection 132 may be disposed on the front side of the container body 120 at a zero-degree position with respect to the axis 101, and the second projection 138 may be disposed on the rear side of the container body 120 at a one-hundred-eighty-degree position with respect to the axis 101. In other words, the first and second projections 132, 138 may be spaced apart approximately one-hundred-eighty degrees (180°) with respect to the axis 101.

Referring now to FIGS. 1-5, the cap 110 will be discussed in detail according to example embodiments. The cap 110 may be relatively flat and disc-shaped in some embodiments. Also, in some embodiments, the cap 110 may be a molded, plastic, and unitary (i.e., monolithic, one-piece) article. It is emphasized, however, that the cap 110 may vary among different embodiments of the present disclosure.

The cap 110 may include a cover member 150, which may be a substantially circular and flat disc. The cover member 150 may be substantially planar and may be disposed normal to the axis 101. The axis 101 may extend through a central area of the cover member 150. When attached to the container body 120, the cover member 150 may cover over the opening 124 of the neck 126 and restrict access to the inner cavity 122 of the container body.

Also, the cap 110 may include an inner member that depends from the cover member 150 and that is engageable with the neck 126, such as an inner skirt 152. The inner skirt 152 may be annular. The inner skirt 152 may be attached at one end to the underside of the cover member 150 and may depend therefrom. The inner skirt 152 may be substantially centered about and centered on the axis 101. The inner skirt 152 may be configured so as receive the neck 126 and engage the neck 126. In additional embodiments, the inner skirt 152 may be configured to be received within the neck 126 and to engage the neck 126.

Figure 4:
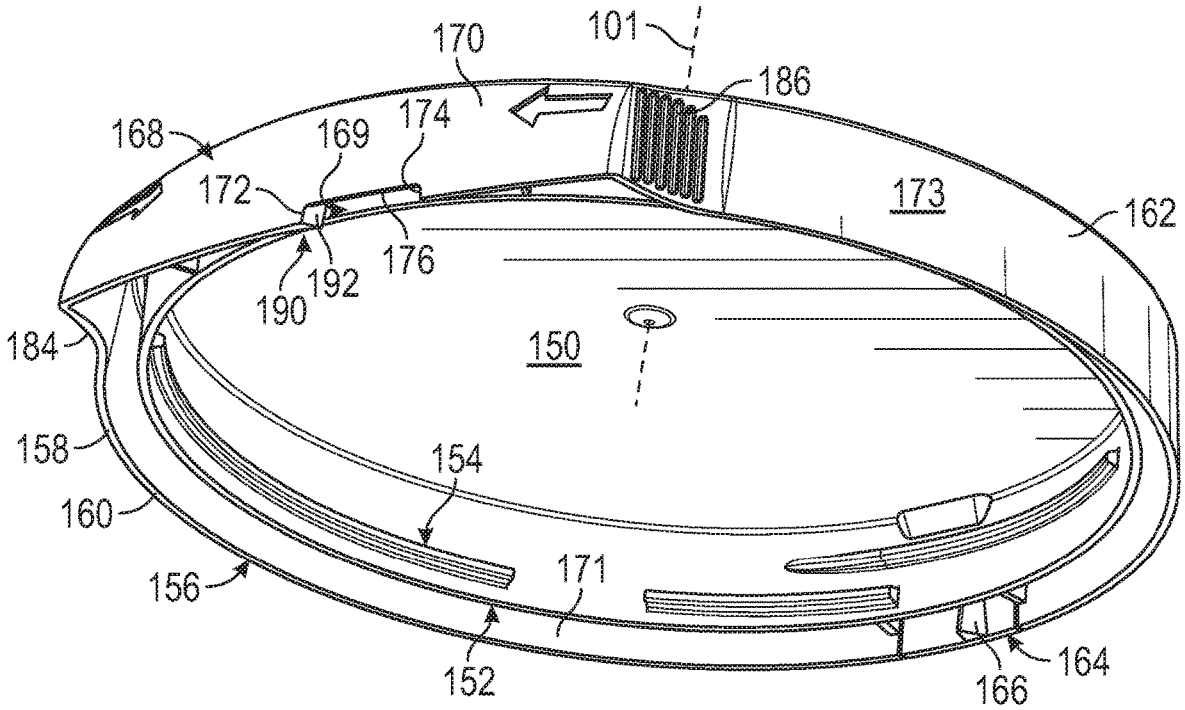
FIG. 4 is an isometric view of the cap of the child-resistant container of FIG. 1 from a front side vantage point.
Figure 5:
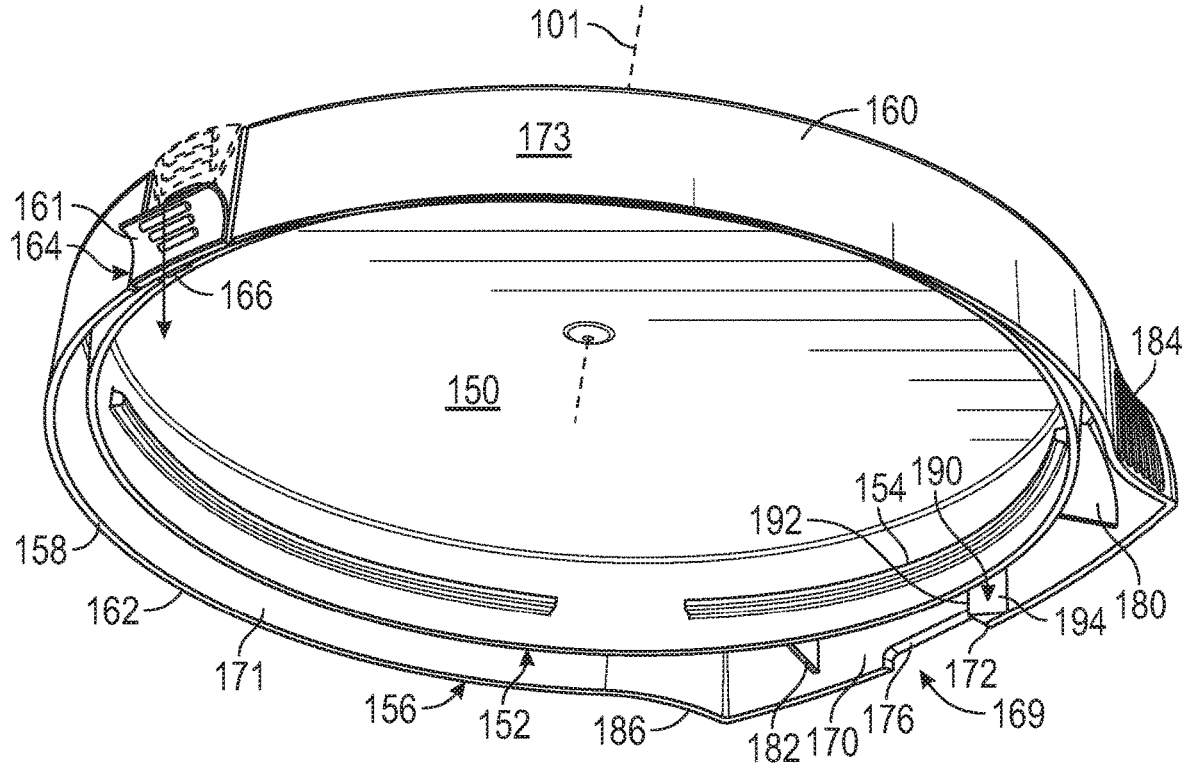
FIG. 5 is an isometric view of the cap of the child-resistant container of FIG. 1 from a rear side vantage point.

As shown in the illustrated embodiments, the cap 110 may include a cap thread 154. The cap thread 154 may be disposed on an inner diameter surface of the inner skirt 152 and may correspond to the neck thread 130 for threadably engaging the container body 120. As shown in FIGS. 4 and 5, the cap thread 154 may be divided into a plurality of discontinuous thread segments. In other embodiments, the cap thread 154 may include a single continuous thread. Although the inner skirt 152 is configured for covering over the neck 126 in the illustrated embodiment, it will be appreciated that the inner skirt 152 may be received within the opening 124 without departing from the scope of the present disclosure. For example, in other embodiments, the cap thread 154 may be included on the outer diameter surface of the inner skirt 152, and the neck thread 130 may be included on the inner diameter surface such that the inner skirt 152 is received within the opening 124 and is removably attached to the neck 126. Furthermore, in additional embodiments of the present disclosure, the cap 110 may be removably attached to the neck 126 in a manner other than a threaded attachment.

The cap 110 may additionally include an outer member that depends from the cover member 150 and that at least partially surrounds the inner skirt 152. For example, the cap 110 may include an outer skirt 156. The outer skirt 156 may be attached at one end to the outer periphery of the cover member 150 and may depend therefrom. As such, the outer skirt 156 may extend about the axis 101 and may surround, encompass, and/or encircle the inner skirt 152.

The outer skirt 156 may include an inner surface 171 that faces inward radially toward the inner skirt 152 and toward the axis 101. The outer skirt 156 may also include an outer surface 173 that face outward radially from the axis 101. Moreover, the outer skirt 156 may include a lower edge 158 that is spaced apart from the cover member 150 along the axis 101. The lower edge 158 of the outer skirt 156 may be disposed lower than the inner skirt 152 with respect to the axis 101.

Figure 3:
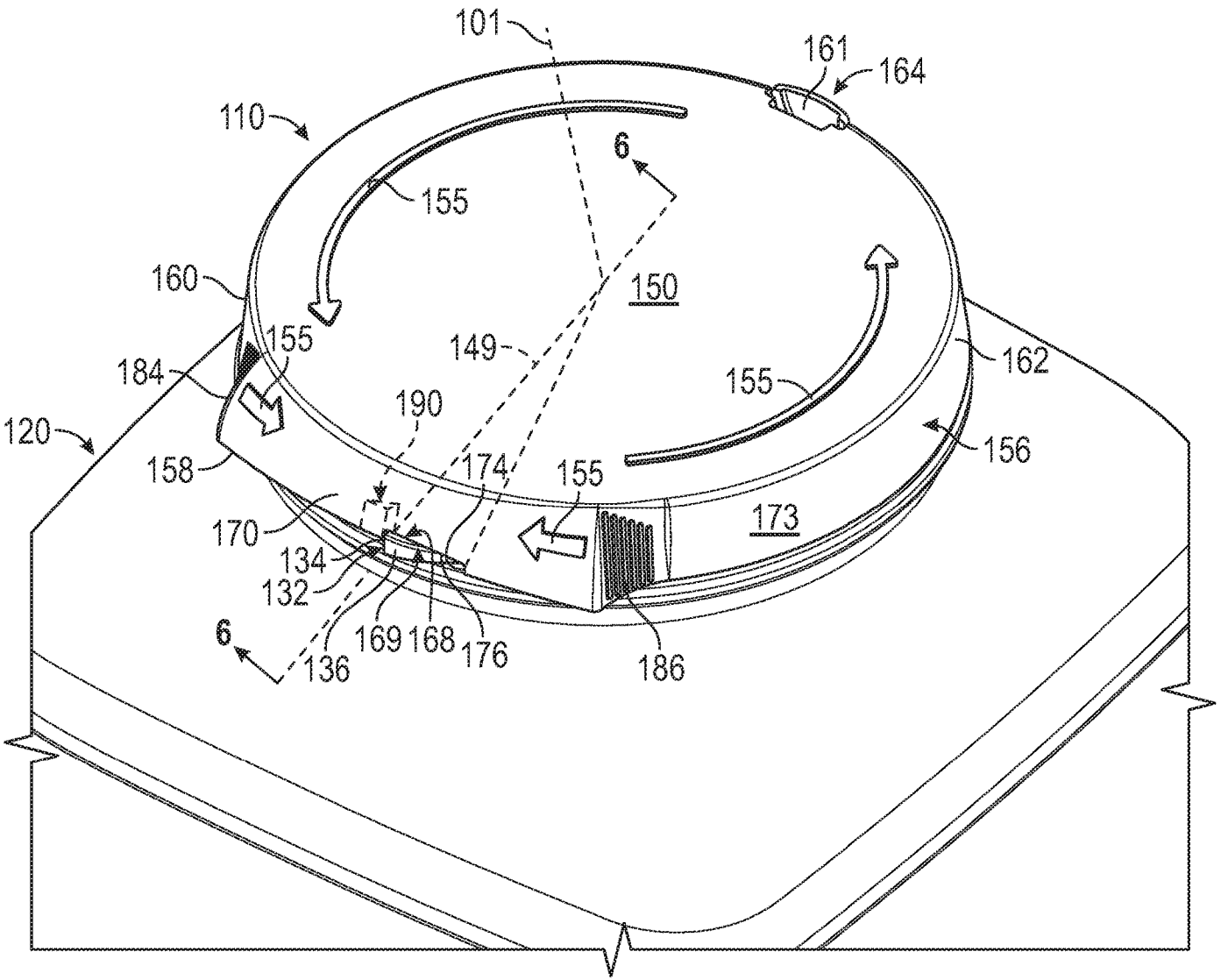
FIG. 3 is an isometric view of the child-resistant container of FIG. 1 shown with the cap attached to the neck.

The outer surface 173 of the outer skirt 156 and the top surface of the cover member 150 may cooperatively define the exterior of the cap 110. The outer surface 173 may define the outer radial exterior surfaces of the cap 110. When the cap 110 is attached to the container body 120, these same surfaces may define the upper exterior of the container 100. A majority of the outer surface 173 may be substantially flush with the collar 128 as shown in FIG. 3. Furthermore, the outer surface 173 of the outer skirt 156 may include illustrations or other messages, such as instructions to the user for removing the cap 110. In some embodiments one or more of these surfaces may include embossed or debossed arrows 155, illustrations of a hand manually opening the cap 110, or other messages indicating how to manipulate the cap 110 for removal.

The outer skirt 156 may be sub-divided into different members, areas, and/or portions. For example, the outer skirt 156 may include a first arcuate segment 160 and a second arcuate segment 162. The first and second arcuate segments 160, 162 may be disposed on opposite sides of the axis 101 and substantially centered on the axis 101.

Furthermore, the outer skirt 156 may include a tamper-evident member 164. The tamper-evident member 164 may connect neighboring ends of the first and second arcuate segments 160, 162. The tamper evident member 164 may include an abutment member 166 (FIG. 4). The abutment member 166 may be wedge-shaped and may project radially inward from the inner surface of the tamper-evident member 164 toward the axis 101. The tamper-evident member 164 may also include a tab 161. As will be discussed below, the cap 110 may be attached to the container body 120 such that the abutment member 166 engages the second projection 138 of the neck 126 to thereby retain the cap 110 on the container body 120. Also, the tamper-evident member 164 may be selectively altered between a first arrangement and a second arrangement. The tamper-evident member 164 may be selectively deformable. For example, the tamper-evident member 164 may be a frangible member that may be at least partially removed from the cap 110. For example, as shown in FIG. 5, the tamper-evident member 164 may be embodied as a tear-away tab or strip that may be selectively peeled and torn away in a longitudinal direction substantially along the axis (e.g., downward toward the container body). This action may disconnect the tamper-evident member 164 from the first and second arcuate segments 160, 162 of the outer skirt 156. Once removed, the tamper-evident member 164 no longer retains the cap 110 on the container body 120.

Figure 7:
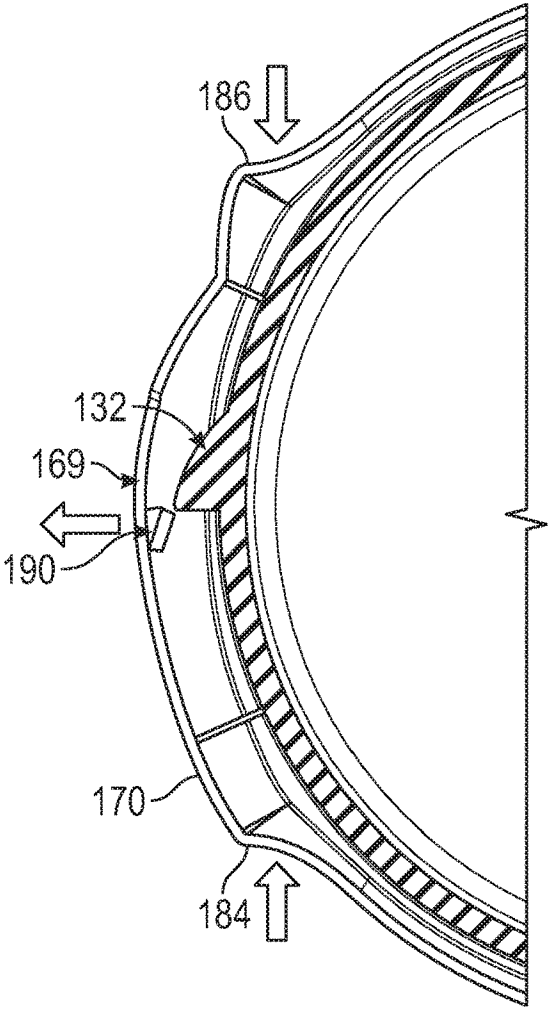
FIG. 7 is a section view of the child-resistant container, wherein the cap is shown in the first threaded position on the neck and the wall is shown in a second radial position.

As shown in FIG. 3, the cap 110 may further include a child-deterring (child-resistant) retainer feature 168. In general, the retainer feature 168 may be moveable between various positions. For example, the retainer feature 168 may be resiliently flexible and moveable from a neutral position (FIG. 6) to a flexed position (FIG. 7). The retainer feature 168 may be biased toward the neutral position and away from the flexed position. The retainer feature 168 may be selectively moved between these positions to removably secure the cap 110 to the neck 126.

The retainer feature 168 may be embodied as a resiliently flexible wall 170 of the outer skirt 156. The wall 170 may extend arcuately between the first and second arcuate segments 160, 162. The wall 170 may have a greater radius than the first and second arcuate segments 160, 162 and may be eccentric relative to the axis 101.

The outer skirt 156 may further include a first pad 184 and a second pad 186. The first pad 184 and the second pad 186 may be disposed on opposite ends of the wall 170. The first pad 184 may project radially outward and may contour concavely from the first arcuate segment 160 to the wall 170. The second pad 186 may project radially outward and may contour concavely from the second arcuate segment 162 to the wall 170. In additional embodiments, the first and/or second pad 184, 186 may be flat and planar and may project radially outward. Furthermore, the first and/or second pads 184, 186 may include one or more gripping features that provide friction and/or improved grip. These gripping features may include one or more raised bumps, ribs, etc., and/or one or more recessed areas. As will be discussed, the first and second pads 184, 186 may be squeezed together. For example, the user may use one finger in each of the first and second pads 184, 186 and squeeze the pads 184, 186 together. This may cause the pads 184, 186 to move toward each other in a tangential and/or circumferential direction and may cause the wall 170 to flex outward in the radial direction. In some embodiments, the squeezing of the pads 184, 186 may also cause the wall 170 to flex upward slightly in an arcuate path. The applied load may cause the middle area of the wall 170 to bend and buckle outward radially and upward. In other words, the wall 170 may move from the neutral position of FIG. 6 to the outwardly flexed position of FIG. 7. Once the load is reduced, the wall 170 may bias back toward the neutral position of FIG. 6.

Moreover, the wall 170 may include an aperture 169. In some embodiments, the aperture 169 may be a notch, groove, or other opening in the lower edge 158 of the outer skirt 156. The aperture 169 may be defined by a first inner rim edge 172, a second inner rim edge 174, and an upper rim edge 176. The first and second inner rim edges 172, 174 may be spaced apart angularly with respect to the axis 101. The first and second inner rim edges 172, 174 may face opposite each other in the circumferential direction and/or the tangential direction about the axis 101 to define a width dimension of the aperture 169. The upper rim edge 176 may face substantially downward along the axis 101 toward the container body 120. Thus, the aperture 169 may be a notch that is elongate in the circumferential/tangential direction. In other words, as shown in FIG. 3, the aperture 169 may extend along a sector 149 of the cap 110. The sector 149 is defined between the first and second inner rim edges 172, 174 relative to the axis.

As shown in FIGS. 4 and 5, the cap 110 may also include a lug 190. The lug 190 may be wedge shaped and may extend inward radially from the inner surface 171. The lug 190 may include an abutment surface 192 that is substantially planar and substantially flush with the first inner rim edge 172. The lug 190 may further include a tapered surface 194. The tapered surface 194 may face inward toward the axis 101 and may gradually taper between the abutment surface 192 and the inner surface 171 of the wall 170.

Furthermore, the cap 110 may include a first rib 180 and a second rib 182. The first and second ribs 180, 182 may extend radially between the wall 170 and the inner skirt 152. The first and second ribs 180, 182 may be spaced apart in the circumferential direction about the axis 101.

The aperture 169 in the wall 170 may be spaced apart from the tamper-evident member 164 circumferentially. These features may be disposed on opposite sides of the axis 101 and spaced apart angularly about the axis 101 from each other. For example, the aperture 169 may be spaced apart approximately one hundred eighty degrees (180°) from the tamper-evident member 164 of the cap 110.

It is noted that the cap thread 154 may be arranged according to the position of the aperture 169. For example, as shown in FIG. 2, the cap thread 154 may be continuous directly above the aperture 169. In other words, the cap thread 154 may be continuous circumferentially across the same sector 149 as the aperture 169 relative to the axis 101. As such, the threaded attachment between the cap 110 and the container body 120 may be especially robust and may prevent a user from prying the cap 110 off the container body 120 using the wall 170.

Thus, the cap 110 may be removably attached to the neck 126 of the container body 120. The position illustrated in FIGS. 3 and 6 may be referred to as a fully threaded position of the cap 110 on the neck 126. The cover member 150 may cover over the opening 124 in this position. Also, as shown, the wall 170 may be unflexed and disposed in its neutral position with the first projection 132 of the neck 126 received in the aperture 169 of the wall 170. This position of the wall 170 may be also be referred to as a retained position of the wall 170. The wall 170 may be disposed proximate the projection 132 with the abutment surface 134 abutting against the opposing inner rim edge 172 and abutment surface 192. As such, the projection 132 may interfere with rotational movement of the cap 110 in the twist-off direction.

Moreover, in this position, the tamper-evident member 164 may be engaged with the second projection 138 of the neck 126. The abutment member 166 of the tamper-evident member 164 may abut against the opposing abutment surface 140 of the second projection 138 to further prevent twist-off. Accordingly, the tamper-evident member 164 may be redundant to the retainer feature 168 such that the cap 110 is robustly secured to the neck 126.

To remove the cap 110, the user may first remove the tamper-evident member 164. The user may grasp the tab 161 and pull downward to tear it from the first and/or second arcuate segments 160, 162 as shown in FIG. 5. In other words, the user may selectively and permanently alter the tamper-evident member 164 from a first, attached, arrangement to a second, torn, arrangement. This eliminates rotational interference between the second projection 138 and the abutment member 166 (i.e., the abutment member 166 disengages the second projection 138 when the tab 161 is torn away).

Figure 8:
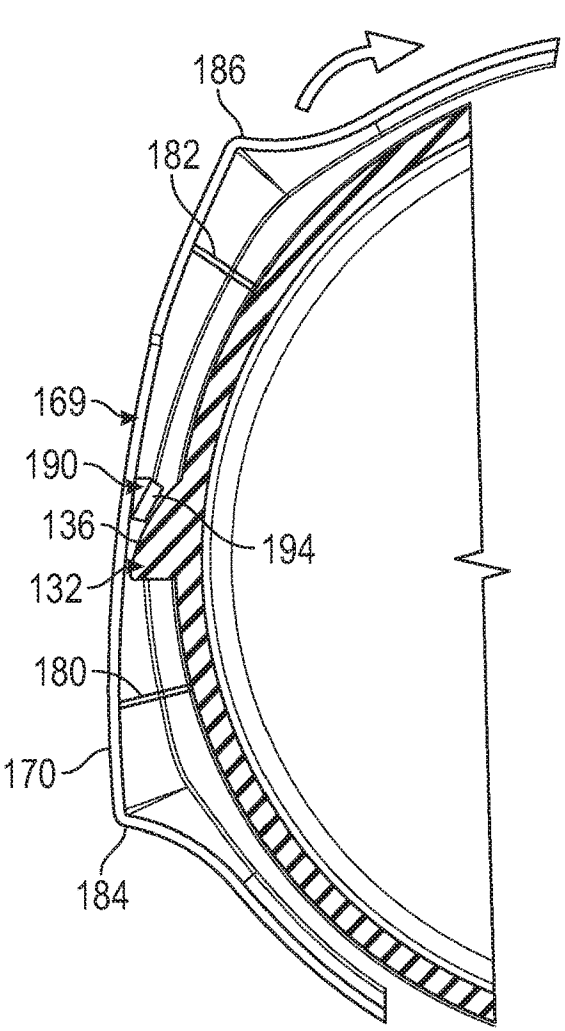
FIG. 8 is a section view of the child-resistant container, wherein the cap is shown in a second threaded position on the neck and the wall is shown flexing between the first and second radial positions.

Then, the user may squeeze together the first and second pads 184, 186 as shown in FIG. 7. This may cause the wall 170 to resiliently flex outward radially. Specifically, areas of the wall 170 that lie between the ribs 180, 182 may bow, bend, and buckle outward radially and/or upward toward the flexed position. It is noted that the cap 110 may remain in the fully threaded position as the pads 184, 186 are squeezed together and the wall 170 is flexed outward/upward. This may move the lug 190 away from the projection 132 such that there is rotational clearance between the two features (i.e., the lug 190 no longer interferes with twist-off rotation of the cap 110 from the container body 120). In other words, the projection 132 may be radially spaced away from and disposed outside the aperture 169. This may be referred to as the unretained position of the wall 170 because it is now ready to bypass the projection 132 when rotated relative to the container body 120. Specifically, the user may maintain the squeezing pressure on the pads 184, 186 and begin to rotate the cap 110 about the axis 101 in the twist-off direction. As shown in FIG. 8, the cap 110 may move to a second threaded (partially threaded) position on the neck 126, wherein the wall 170 has moved angularly relative to the projection 132. The wall 170, in this position, may begin to resiliently recover back to the neutral position. The user may release the pads 184, 186 and continue to twist the cap 110 off of the neck 126.

Figure 6:
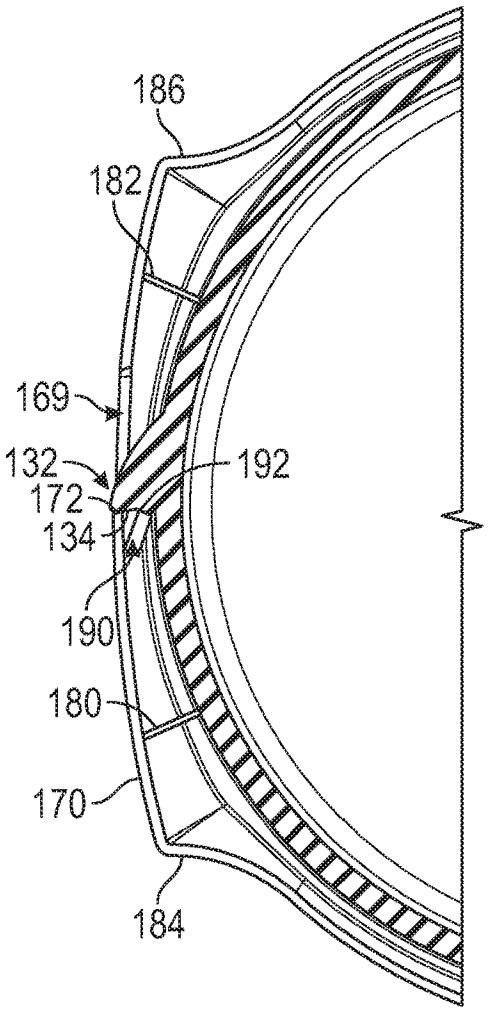
FIG. 6 is a section view of the child-resistant container taken along the line 6-6 of FIG. 3, wherein the cap is shown in a first threaded position on the neck and a wall of the cap is shown in a first radial position.

To replace the cap 110 onto the neck 126, the user may thread and rotate the cap 110 onto the neck 126 in the twist-on direction. Eventually, the tapered (ramp) surface 194 of the lug 190 encounters the opposing tapered (ramp) surface 136 of the projection 132, similar to FIG. 8. Further rotation of the cap 110 in the twist-on direction causes the surface 194 to cam against the surface 136, camming and flexing the wall 170 outward radially. Still further rotation of the cap 110 in the twist-on direction may cause the wall 170 to resiliently snap back in place in the neutral position with the projection 132 received in the aperture 169 (FIGS. 6 and 3). This assures the user that the cap 110 is secured and retained on the container body 120. Also, the lower end of the cap thread 154 may abut against the thread stop 131 once in this fully threaded position such that the projection 132 is received within the aperture 169, further ensuring that the cap 110 is secured and to prevent against overtightening the cap 110.

It will be appreciated that the projection 132 may be exposed via the aperture 169 when the cap 110 is in the fully threaded position. Accordingly, the aperture 169 provides visual confirmation and assurance that the cap is in the fully threaded position. Likewise, the wall 170 of the cap 110 may audibly snap back into place when the cap is fully threaded to provide assurance that the cap 110 is securely attached.

There has thus been provided child-resistant containers or packages having unique child deterring features that retain the cap in a secured position on the container body. These features may be manipulated to unsecure the cap; however, performing these actions may prove physically and/or cognitively challenging for some (e.g., young children). These features may, in fact, be configured for other users (e.g., adults) such that the child-deterring features may be intuitive and ergonomic for use. Thus, the container of the present disclosure may provide relatively high levels of child deterrence, while remaining relatively easy-to-use for the majority of adults. The container may be manufactured efficiently as well.

Figure 9:
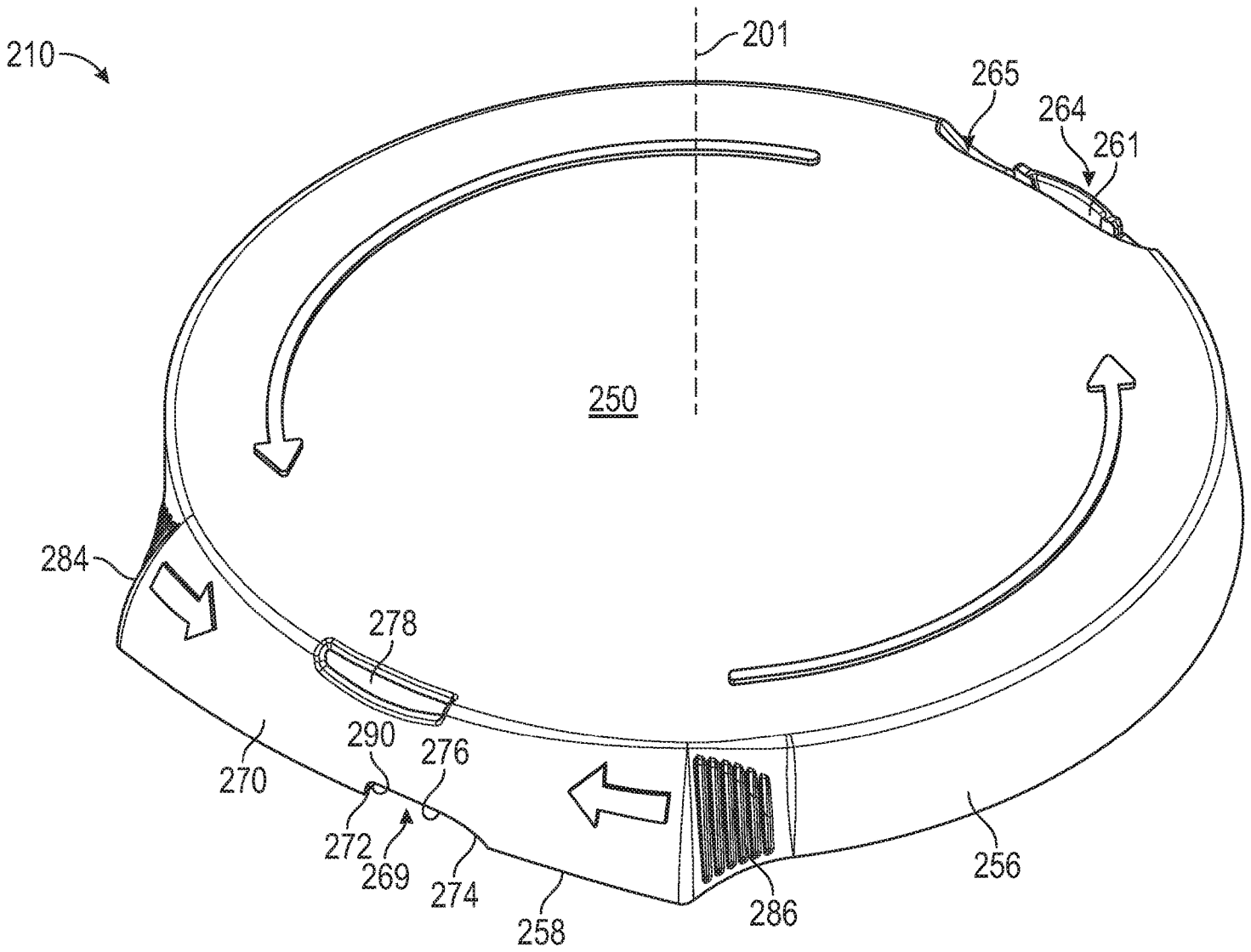
FIG. 9 is an isometric view of the cap of the child-resistant container of the present disclosure according to additional embodiments.
Figure 10:
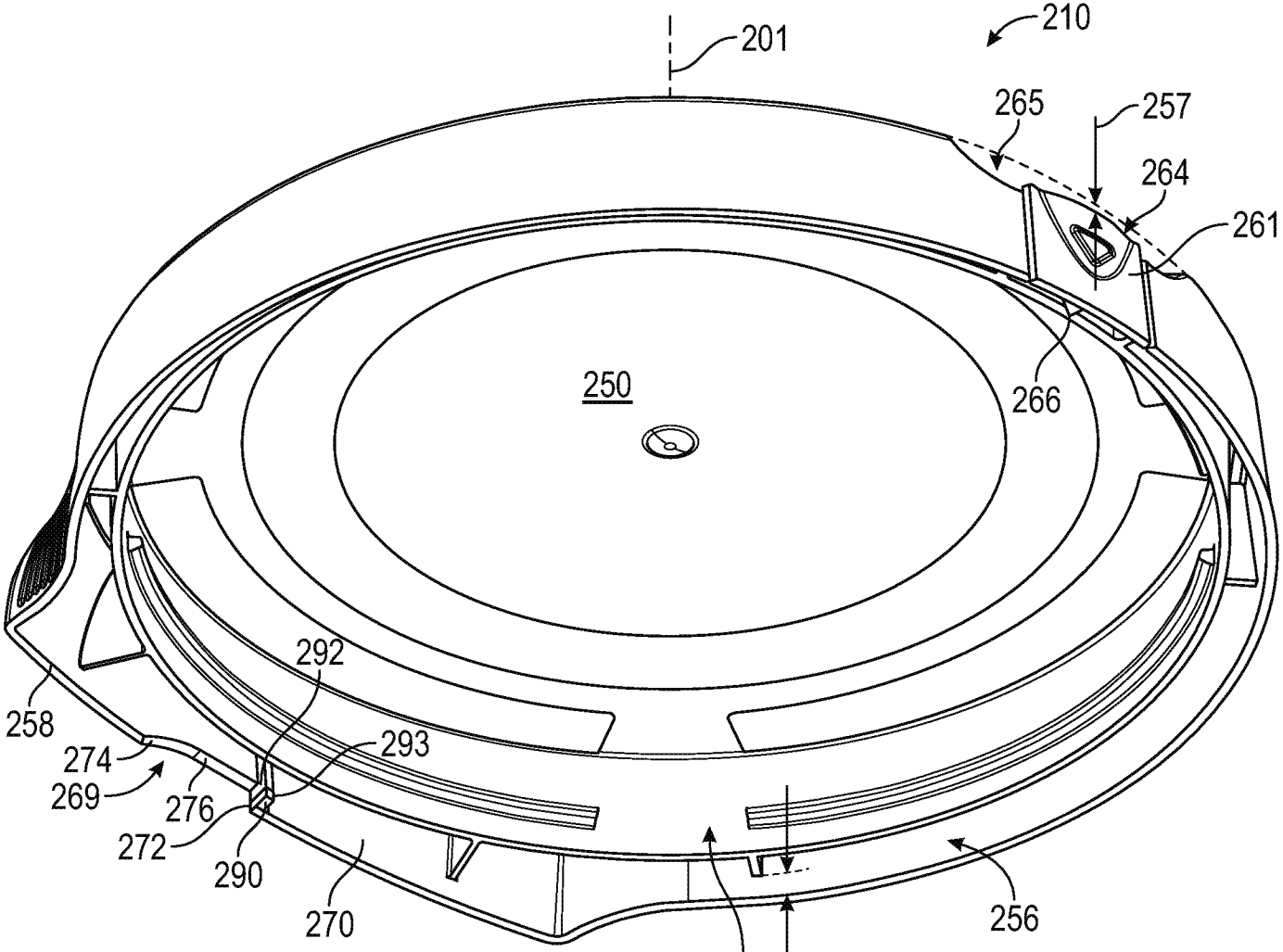
FIG. 10 is an isometric view of the underside of the cap of FIG. 9.

Referring now to FIGS. 9 and 10, the cap 210 of the present disclosure is shown according to additional embodiments. The cap 210 may be substantially similar to the cap 110 of FIGS. 1-8 except as detailed below. Components that correspond to those of FIGS. 1-8 are indicated in FIGS. 9 and 10 with corresponding reference numbers increased by 100.

As shown, the cap 210 may include the cover member 250, the inner skirt 252 and the outer skirt 256. Like the embodiments discussed above, the outer skirt 256 may depend from the cover member 250 (along the axis 201) further than the inner skirt 252. As such, the lower edge 258 of the outer skirt 256 may be spaced at a distance 253 from the corresponding lower edge of the inner skirt 252 with respect to the axis 201.

The outer skirt 256 may include the tamper-evident member 264. In some embodiments, the tamper-evident member 264 may comprise the tear-away tab 261. The tab 261 may be spaced apart at a distance 257 from the planar upper surface of the cover member 250 with respect to the axis 201. Accordingly, an arcuate recess 265 may be defined in the top side of the cap 210, proximate the transition between the cover member 250 and the outer skirt 256. The tamper-evident member 264 may be partly disposed within the recess 265. The upper end of the tab 261 may project slightly upward from surrounding areas for gripping and tearing away the tab 261. Also, the lower, inner end of the tab 261 may include the abutment member 266 (FIG. 10). The abutment member 266 may be substantially flush with the lower edge 258 of the outer skirt 256.

Moreover, as shown in FIG. 9, the cap 210 may include an elongate opening 278 proximate the transition between the wall 270 and the cover member 250. The opening 278 may be substantially centered on the wall 270 and angularly spaced approximately equally from the pads 284, 286. The opening 278 may be elongate in the circumferential direction about the axis 201. Also, the opening 278 may be a through-hole or slot that extends entirely through the wall 270 and/or the cover member 250.

Furthermore, the aperture 269 may be shaped differently than the embodiments of FIGS. 1-8. The aperture 269 may be a notch that is defined by the first inner rim edge 272, the second inner rim edge 274, and the upper rim edge 276. The first inner rim edge 272 may be planar and substantially parallel to the axis 201. The upper rim edge 276 may be planar and substantially perpendicular to the axis 201. The second inner rim edge 274 may taper and curve concavely from the upper rim edge 276 to the lower edge 258. Accordingly, the aperture 269 may be somewhat wedge-shaped.

Additionally, as shown in FIG. 10, the lug 290 may be disposed proximate the first inner rim edge 272 of the aperture 269. The abutment surface 292 of the lug 290 may be substantially planar and parallel to the axis 201 and substantially flush with the first inner rim edge 272. An opposing surface 293 of the lug 290 may also be substantially planar and parallel to the axis 201. The lug 290 may also be substantially flush with the lower edge 258 of the outer skirt 256.

The cap 210 may be configured to selectively engage the neck 126 of the container body 120 similar to the embodiments of FIG. 1-8. Specifically, when fully threaded on the neck 126, the aperture 269 may receive the first projection 132. As such, the lug 290 may rotationally interfere with the first projection 132 and retain the cap 210 on the neck 126. The wedge-shaped aperture 269 may substantially conform to the first projection 132 for an aesthetically pleasing effect while still revealing the projection 132 and ensuring that the cap 210 is retained on the neck 126. Also, the abutment member 266 of the tamper-evident member 264 may rotationally interfere with the second projection 138 to further retain the cap 210.

To remove the cap 210, the tamper-evident member 264 may be removed, and the user may squeeze the pads 284, 286 toward each other. Because of the opening 278, wall 270 may flex outwardly radially while also rotating slightly upward away from the neck 126. In other words, the opening 278 may cause the transition between the wall 270 and the cover member 250 to be resiliently flexible for allowing rotational movement of the wall 270 (and the lug 290) relative to the cover member 250. Thus, squeezing the pads 284, 286 may resiliently flex the wall 270 radially outward and rotationally upward, creating rotational clearance between the lug 290 and the projection 132, and thereby allowing the cap 210 to be twisted off the neck 126.

To replace the cap 210, the cap 210 may be threadably advanced onto the neck 126 until the lug 290 abuts against the tapered surface 136 of the first projection 132. The lug 290 may cam against the tapered surface 136 to flex the wall 270 outward radially and upward. This movement may provide clearance between the lug 290 and the projection 132, thereby allowing the cap 210 to be threadably advanced. Once the lug 290 advances past the projection 132, the wall 270 may resiliently recover, and the projection 132 may be received within the aperture 269 to retain the cap 210 in the fully threaded position.

Thus, the cap 210 of FIGS. 9 and 10 may be highly ergonomic and useful for deterring children from removing the cap 210 from the neck 126. In addition, the cap 210 may provide certain manufacturing advantages. For example, in cases where the cap 210 is a molded part, the opening 278 may relieve mold stress and reduce part shrinkage of the cap 210.

Figure 11:
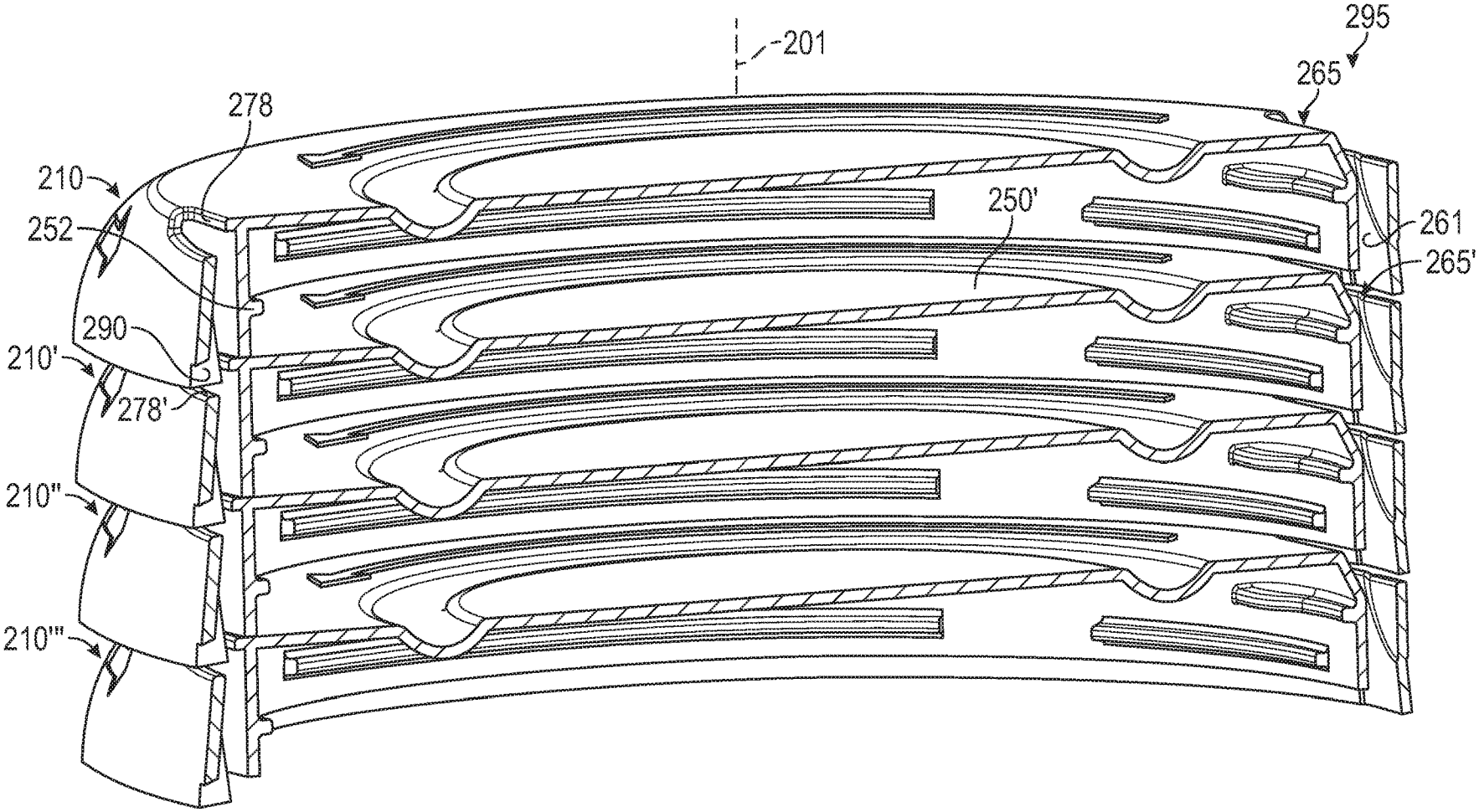
FIG. 11 is an isometric view of a plurality of caps of FIG. 9 shown in a stacked arrangement according to example embodiments.

Also, as shown in FIG. 11, a plurality of caps 210 may be stacked (i.e., provided in a stacked arrangement 295) as shown in FIG. 11. Four caps 210, 210', 210", 210'" are shown in the stacked arrangement 295 of FIG. 11 as an example. Stacking in this manner may be necessary for shipping and handling purposes. For purposes of discussion, the cap 210 will be referred to as the first cap, and the cap 210' will be referred to as the second cap. As shown, the first cap 210 is stacked atop the second cap 210'. Each of the caps 210, 210', 210", 210'" may be stacked in the same manner.

Specifically, in the stacked arrangement 295, the cover member 250' of the second cap 210' can abut and support the lower edge of the inner skirt 252 of the first cap 210. As such, the cover members 250, 250' may be substantially parallel and spaced apart in the stacked arrangement 295. Thus, the stacked arrangement 295 may be very stable for improved shipping and handling activities.

Furthermore, the opening 278' of the second cap 210' may receive the lug 290 of the first cap 210. Likewise, the recess 265' of the second cap 210' may receive the tear-away tab 261 (and the abutment member 266) of the first cap 210. As such, the stacked caps 210, 210' may engage each other rotationally about the axis 201. This engagement may maintain the caps 210, 210' in a uniform angular orientation with respect to the axis 201 because the lug 290 of one cap 210 is received in the opening 278 of another and because the abutment member 266 of one cap 210 is received in the recess 265 of another. Thus, the caps 210 may be stacked neatly and predictably for shipping, handling, etc.

While the foregoing description focuses primarily on articles of manufacture, namely, child-resistant containers, there has also been disclosed methods for manufacturing child-resistant containers. Such methods for manufacturing child-resistant containers having the features discussed herein may entail direct fabrication of any component included within the cap and/or neck of the container, partial or complete assembly of the cap and/or neck, or any combination thereof. Further, any number of entities can fabricate the components of the container, which can be produced utilizing various manufacturing techniques including, but not limited to, blow molding, injection molding, and additive manufacturing processes. Furthermore, a method for manufacturing a child-resistant package may include the step or process of installing and attaching the cap to the container neck. In further instances, the above-described method for manufacturing a child-resistant package may include the step or process of providing the neck (whether by purchase from a supplier, by independent fabrication, or by otherwise obtaining the container neck). Additionally, in at least some implementations, the method may include providing the cap (whether by purchase, by independent fabrication, or by otherwise obtaining the cap).

Terms such as "first" and "second" have been utilized above to describe similar features or characteristics (e.g., rotational directions) in view of the order of introduction during the course of description. In other sections of this Application, such terms can be varied, as appropriate, to reflect a different order of introduction. While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It is understood that various changes may be made in the function and arrangement of elements described in an exemplary embodiment without departing from the scope of the invention as set forth in the appended claims.

What is claimed is:

1. A method of manufacturing a child-resistant container comprising:

providing a container body having a neck that defines an opening to an inner cavity within the container body, the opening defining an axis extending therethrough, the neck including a projection that projects radially away from the axis; and providing a cap having a cover member as well as an inner skirt and an outer skirt that depend from the cover member, the outer skirt disposed outboard radially from the inner skirt with respect to the axis, the outer skirt including a first arcuate segment, a second arcuate segment, and a wall disposed circumferentially between the first and second arcuate segments with respect to the axis, the wall defining at least part of an exterior of the cap, the wall including an aperture extending therethrough;

attaching the inner skirt removably to the neck such that the cap is in a first position on the neck of the container with the projection received within the aperture of the wall of the cap, the inner skirt supported for movement on the neck from the first position toward a second position;

the wall being resiliently flexible for radial movement between a retained position and an unretained position with respect to the neck;

the wall, in the retained position, disposed outboard radially from the first arcuate segment and the second arcuate segment;

the wall, in the retained position, disposed proximate the neck with the projection received in the aperture to retain the cap in the first position, the aperture visibly exposing the projection from the exterior of the container to visually confirm the cap is in the retained position;

the wall, in the unretained position, spaced apart radially away from the projection with the projection outside the aperture to allow movement of the cap from the first position toward the second position.

2. The method of claim 1, wherein the cap is supported by the neck for rotational movement about the axis as the cap moves between the first position and the second position; and wherein the wall, in the retained position, is disposed with the projection received in the aperture to limit rotational movement of the cap about the axis in a first direction away from the first position and toward the second position.

3. The method of claim 2, wherein the wall includes a first inner rim edge and a second inner rim edge that are spaced apart angularly with respect to the axis to define the aperture;

wherein the cap includes a lug that is attached to the wall proximate the first inner rim edge, the lug projecting radially inward from the first inner rim edge;

wherein the lug includes an abutment surface that is flush with the first inner rim edge, the abutment surface configured to abut the projection to retain the cap in the first position.

4. The method of claim 2, wherein the inner skirt of the cap includes a cap thread that threadably engages a neck thread of the neck;

wherein the aperture extends across a sector of the cap with respect to the axis; and wherein the cap thread is continuous across the sector of the cap.

5. The method of claim 2, wherein the cap is supported for rotation about the axis in the first direction and in a second direction that is opposite the first direction;

further including a thread stop that limits rotation of the cap about the axis in the second rotational direction once the cap reaches the first position.

6. The method of claim 1, wherein the wall has a lower edge; and wherein the aperture is a notch in the lower edge of the wall.

7. The method of claim 1, wherein the outer skirt of the cap includes a first pad and a second pad that are disposed on opposite ends of the wall, the first pad and the second pad configured to be squeezed in unison to resiliently flex the wall from the retained position toward the unretained position; and wherein the wall is biased toward the retained position.

8. A method of manufacturing a child-resistant container comprising:

providing a container body having a neck that defines an opening to an inner cavity within the container body, the opening defining an axis extending therethrough, the neck including a projection that projects radially away from the axis;

providing a cap having a cover member as well as an inner skirt and an outer skirt that depend from the cover member, the outer skirt disposed outboard radially from the inner skirt with respect to the axis, the outer skirt including a first arcuate segment, a second arcuate segment, and a wall disposed circumferentially between the first and second arcuate segments with respect to the axis, the outer skirt including a first pad that projects out radially from the axis to connect the first arcuate segment and the wall, the outer skirt including a second pad that projects out radially from the axis to connect the second arcuate segment and the wall, the wall defining at least part of an exterior of the cap, the wall including an aperture extending therethrough;

engaging the inner skirt removably to the neck to be supported on the neck for movement of the cap between a first position and a second position;

the wall being resiliently flexible for radial movement between a retained position and an unretained position with respect to the neck;

the wall, in the retained position, disposed outboard radially from the first arcuate segment and the second arcuate segment;

the wall, in the retained position, disposed proximate the neck with the projection received in the aperture to retain the cap in the first position, the aperture visibly exposing the projection from the exterior of the cap to visually confirm the cap is in the retained position;

the wall, in the unretained position, spaced apart radially away from the projection with the projection outside the aperture to allow movement of the cap from the first position toward the second position.

9. The method of claim 8, wherein at least one of the first and second pads has concave contour.

10. The method of claim 8, wherein the outer skirt further includes a tamper-evident member configured to be selectively altered from a first arrangement to a second arrangement;

the tamper-evident member, in the first arrangement, configured to engage the container body to retain the cap in the first position; and the cap supported for movement from the first position toward the second position with the tamper-evident member in the second arrangement.

11. The method of claim 10, wherein the tamper-evident member, in the first arrangement, is spaced apart from the cover member to define a recess, the recess configured to receive another tamper-evident member of another child-resistant cap that is stacked thereon.

12. The method of claim 8, further comprising an elongate opening disposed proximate a transition between the wall and the cover member.

13. The method of claim 12, wherein the cap includes a lug that is attached to the outer skirt proximate the first inner rim edge, the lug projecting radially inward from the first inner rim edge; and wherein the elongate opening is configured to receive another lug of another child-resistant cap that is stacked thereon.

14. The method of claim 8, wherein the projection includes an abutment surface that is configured to abut against a rim edge of the aperture to retain the cap in the first position; and wherein the projection includes a tapered surface that is configured to cam the outer skirt outward radially as the cap rotates away from the second position toward the first position.

15. A method of manufacturing a child-resistant cap for a container body having a neck that defines an opening to an inner cavity within the container body, the neck including a projection that projects radially away from an axis, the child-resistant cap comprising:

forming the child-resistant cap to include a cover member, an inner skirt, and an outer skirt, the inner skirt depending from the cover member and defining the axis, the outer skirt depending from the cover member and extending about the inner skirt and the axis, the outer skirt disposed outboard radially from the inner skirt with respect to the axis, the outer skirt including a first arcuate segment, a second arcuate segment, and a wall disposed circumferentially between the first and second arcuate segments with respect to the axis, the wall partly defining an exterior of the cap, the wall including an aperture extending therethrough, the wall being resiliently flexible for radial movement between a retained position and an unretained position with respect to the axis;

the cover member configured to cover over the opening;

the inner skirt configured to threadably engage the container body and move between a first threaded position and a second threaded position relative to the container body;

the wall, in the retained position, disposed outboard radially from the first arcuate segment and the second arcuate segment;

the wall, in the retained position, configured to be disposed with the projection received in the aperture to retain the cap in the first threaded position;

the wall, in the unretained position, configured to be disposed radially from the projection with the projection disposed outside the aperture to allow movement of the cap from the first threaded position to the second threaded position.

16. The method of claim 15, wherein the wall includes a first inner rim edge and a second inner rim edge that are spaced apart angularly with respect to the axis to define the aperture;

wherein the cap includes a lug that is attached to the outer skirt proximate the first inner rim edge, the lug projecting radially inward from the first inner rim edge;

wherein the lug includes an abutment surface that is flush with the first inner rim edge, the abutment surface configured to abut the projection to retain the cap in the first threaded position.

17. The method of claim 15, wherein the cap includes a cap thread configured to threadably engage the container body;

wherein the aperture extends across a sector of the cap with respect to the axis; and wherein the cap thread is continuous across the sector of the cap.

18. The method of claim 15, wherein the outer skirt includes a tamper-evident member configured to be selectively altered from a first arrangement to a second arrangement;

the tamper-evident member, in the first arrangement, configured to engage the container body to retain the cap in the first threaded position; and the cap configured to move from the first threaded position toward the second threaded position with the tamper-evident member in the second arrangement.

19. The method of claim 15, wherein the wall has a lower edge; and wherein the aperture is a notch in the lower edge of the wall.

* * * * *